United States Patent [19]

Edwards

[11] 4,047,420

[45] Sept. 13, 1977

[54] PRESS FOR SWAGING METAL SLEEVES

[75] Inventor: Hugh Jeremy Willis Edwards, Guisely, England

[73] Assignee: CCL Systems Limited, England

[21] Appl. No.: 710,489

[22] Filed: Aug. 2, 1976

[30] Foreign Application Priority Data

Aug. 4, 1975 United Kingdom ..... 32600/75

[51] Int. Cl.[2] ..... B21D 37/02

[52] U.S. Cl. ..... 72/416; 29/237; 72/453.15

[58] Field of Search ..... 72/412, 415, 416, 470, 72/367, 456, 402, 453.01, 453.15; 29/517, 237

[56] References Cited

U.S. PATENT DOCUMENTS

| | | | |
|---|---|---|---|
| 2,030,686 | 9/1931 | Davis | 72/453.01 |
| 2,940,497 | 6/1960 | Herrstrum | 72/453.01 |
| 3,771,343 | 11/1973 | Dawson | 72/402 |
| 3,823,597 | 7/1974 | Hanback | 29/237 |

*Primary Examiner*—C.W. Lanham

*Assistant Examiner*—Gene P. Crosby

*Attorney, Agent, or Firm*—Caesar, Rivise, Bernstein & Cohen, Ltd.

[57] ABSTRACT

A press adapted for use in confined areas for swaging a sleeve onto reinforcing bars to splice them together. The press comprises a cylinder having a longitudinal axis with a piston therein and reciprocable along said axis, said cylinder having an end and a pair of spaced arms extending from said end in a direction generally parallel to said cylinder, with the distance generally between the outer surfaces of said arms measured in a direction transverse to said longitudinal axis being less than the outer diameter of the cylinder. A bridging member is detachably secured to and bridges the arms. A first die part is secured to the free end of the piston and a second cooperable die part is secured to the bridging member. The die parts cooperate together to swage the sleeve onto the bars by the movement of the first die. piece toward the second die piece in accordance with the movement of the piston along said longitudinal axis.

2 Claims, 3 Drawing Figures

PRESS FOR SWAGING METAL SLEEVES

This invention relates generally to presses and more particularly to die mounting presses for use in confined spaces.

Various presses for holding forming dies therein have been disclosed in the prior art and some are commercially available.

The presses disclosed in the prior art and commercially available for use in civil engineering applications, mining engineering applications and marine engineering aplications wherein pairs of reinforcing bars are to be spliced together by the deformation or swaging of a metal sleeve over the ends of the bars suffer from various disadvantages, e.g., complexity, cost, size, etc. The most serious disadvantage of such presses is their inability to operate viably in tight spaces or applications wherein the bars to be joined are closely packed together in an array. Examples of prior art presses exhibiting such a disadvantage are shown the U.S. Pat. No. 676,292 (Wigtel), U.S. Pat. No. 2,533,943 (Klein), U.S. Pat. No. 2,966,192 (Dibner), British Pat. No. 1,293,954 (Zublin) and German Pat. No. 1,280,769 (Pieri).

Accordingly, it is a general object of this invention to provide a forming press which overcomes the disadvantages of the prior art.

It is a further object of this invention to provide a press mounting forming dies therein and particularly adapted for use in confined spaces.

It is still a further object of this invention to provide a press for mounting swaging dies therein for use in confined spaces to splice pairs of reinforcing bars together.

These and other objects of the instant invention are achieved by providing a press adapted for use in confined spaces for forming a workpiece such as a metal sleeve to be swaged onto a reinforcing bar. The press comprises a cylinder having a longitudinal axis with a piston therein and reciprocable along said axis. The cylinder has an end from which a pair of arms extend in the direction generally parallel to the longitudinal axis, with the distance between the outer surfaces of the arms measured in a direction transverse to the longitudinal axis being less than the outer diameter of the cylinder. A bridging member is detachably secured to the arms. A first die part is mounted for reciprocable movement with the piston and a second die part is mounted on the bridging member. The die parts cooperate together to form the workpiece by movement of the first die part toward the second die part in accordance with the movement of the piston along the longitudinal axis.

Other objects and many of the attendant advantages of the instant invention will be readily appreciated as the same becomes better understood by reference to the following detailed description when considered in connection with the accompanying drawing wherein.

Figure 2:
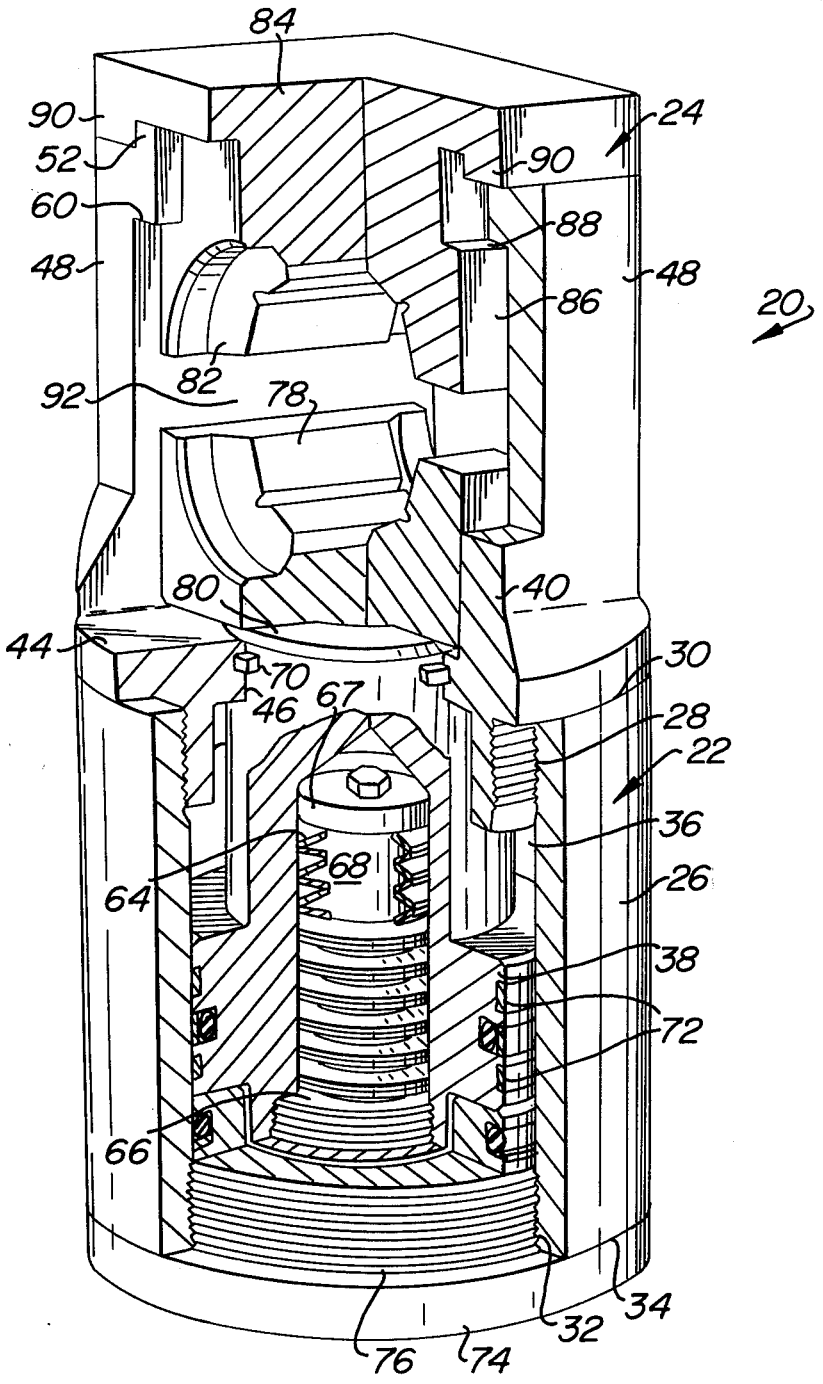
FIG. 2 is a perspective view, partially in section, of the entire press of the invention.

Referring now to the various figures of the drawing wherein like reference characters refer to like parts, there is shown in FIG. 2 a press 20 in accordance with the instant invention and adapted for use in confined spaces for forming a workpiece, such as the swaging of a metal sleeve over the ends of metal reinforcing bars to splice the bars together. As will be seen hereinafter, due to the construction of the press it is particularly suited for splicing ends of reinforcing bars in end-to-end or side-by-side relation together even when the bars are closely packed together and are in a tight array such as can occur in various applications in civil engineering, mining engineering and marine engineering.

Press 20 basically comprises a cylinder 22 and a cap 24, both preferably formed of steel. The cylinder 22 includes a circular side wall 26 having a threaded portion 28 on its inside surface adjacent its upper end 30 and a similar thread 32 on said inside surface adjacent the lower end 34. The side wall 26 encloses a cylindrical interior space 36 in which a stepped piston 38 is disposed. A cylinder top closure member 40 is screwed onto the top 30 of the side wall 26 via a threaded portion 42 which mates with thread 28 on the side wall. If desired, the cylinder top closure member 40 may be formed integrally with the cylinder 22. The cylinder top 40 includes a generally parallel top wall 44 having a central opening 46 therein. The opening extends through the entire thickness of cylinder top 40.

A smaller diameter end portion of the piston 38 extends through opening 46. As will be described in detail hereinafter, the piston 38 is arranged for reciprocal movement within the space 36 and along the longitudinal axis of the cylinder.

Figure 1:
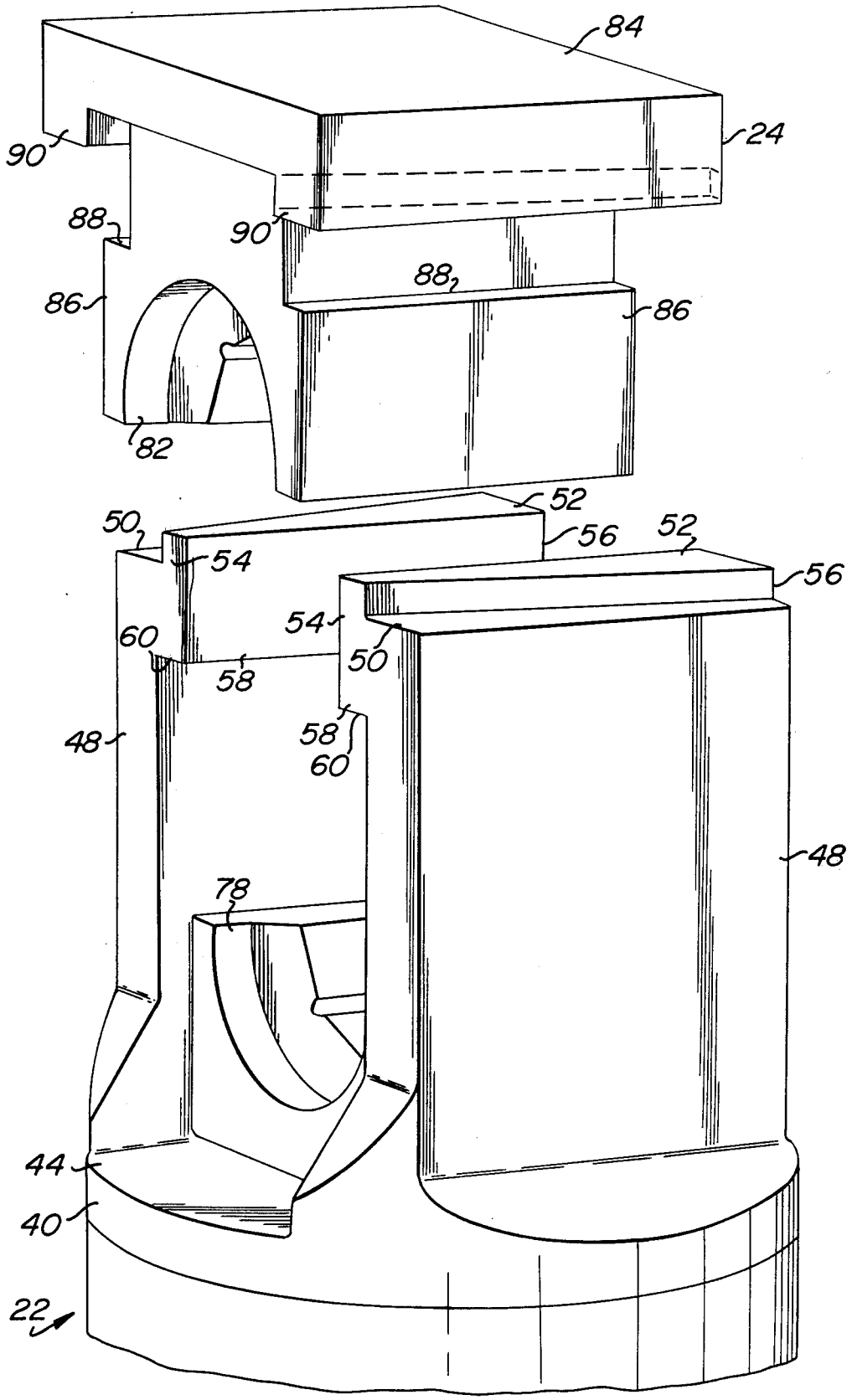
FIG. 1 is an exploded perspective view of a portion of the press of the instant invention to show the separate cylinder and cap.

As can be seen clearly in FIG. 1, a pair of upstanding side arms 48 extend from a planar portion 44 of cylinder top 40 in an upward direction parallel to the longitudinal axis of the cylinder and generally parallel to one another.

As will be described in detail later the cap member 24 is arranged to be detachably secured to the arms 48 to bridge them and form a holder for an upper forming die.

In accordance with a preferred embodiment of the invention the cylinder top 40 and the arms 48 projecting upward therefrom are formed as an integral unit.

Figure 3:
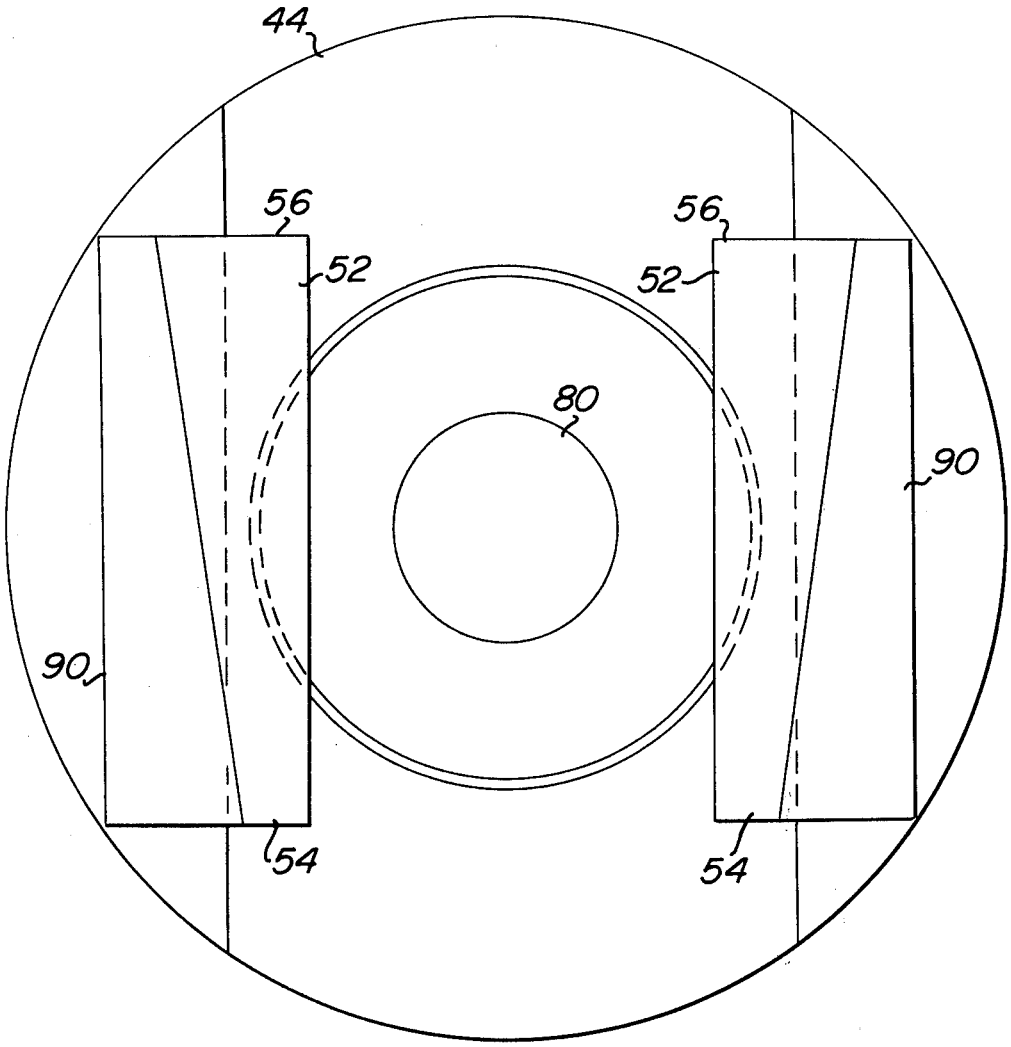
FIG. 3 is a top elevational view of the cylinder shown in FIG. 1 with the die removed.

As can be seen in FIGS. 1 and 3, the free end of each of the arms 48 includes a top surface 50 from which a flange 52 extends. Each flange 52 tapers from the front wall 54 of the arm to the back wall 56 thereof. The free end of each arm 48 also includes an overhanging portion 58 having an underside surface 60. As will be seen in detail later, the under surface 60 serves as a means for holding the cap member 24 in place onto the cylinder top 40 and hence onto cylinder 22 during operation of the press.

As can be seen clearly in FIG. 2, the piston 38 is hollow and contains a return plate spring 64. The spring is engaged or biased between shoulder 66 in the piston base of the cylinder and the end 67 of an internal spring guide 68 in the cylinder. An annular seal 70 is disposed within a corresponding annular recess in the surface of opening 46 and engages the smaller diameter portion of the piston. The larger diameter portion of the piston carries sealing rings 72.

The bottom of the cylinder is closed via a detachable bottom plate 74 having a threaded portion 76 which mates with threaded portion 32 of the cylinder side wall 26. Ports, not shown, extend through the bottom plate 74 to carry a fluid for effecting the reciprocation of the piston along its longitudinal axis toward cap 24.

The press 20 of the instant invention mounts a pair of dies or die parts thereon for deforming a workpiece placed therebetween. To that end, a die 78 is mounted on the upper face 80 of piston 38. Another die 82 is mounted on the underside of the bridging cap member 24. It should be pointed out at this juncture that in lieu of the arrangement shown in the embodiment of the invention shown herein the upper and lower dies 78 and 82, respectively, may be mounted on associated die seatings secured to the piston face 80 and cap 24, respectively.

It should also be pointed out at this juncture that the dies 78 and 82 shown herein represent the particular swaging dies which are the subject of a co-pending U.S. Pat. application Ser. No. 710,815 filed herewith and whose disclosure is incorporated by reference herein. The dies of said corresponding application form no portion of the instant invention.

The cap 24 comprises a flat top portion or plate 84 from which a block having opposed side walls 86 projects downward. The die 82 is at the bottom of the block. Each wall 86 of the block terminates in an upper shoulder or ledge 88. The underside of plate 84 of cap 24 is in the form of a pair of downwardly projecting flanges 90. The flanges are of tapering form and are dimensioned and arranged to compliment the tapered shape of the upwardly projecting flanges 52 on the arms 48. The shoulder 88 on the block is arranged to compliment the underside surface 60 of an associated arm 48.

In use, the cap 24 is slid onto the cylinder to cause the flanges 52 and 90 to engage one another in a wedging manner, with the shoulders 88 abutting and mating with the underside surfaces 60, see FIG. 2, whereupon the flanges are securely held in their wedged engagement. Once the cap 24 is in position, the stationary die 82 is disposed over movable die 78 and spaced therefrom. A sleeve, not shown, together with a reinforcing bar or wire rope, not shown, to which it is to be spliced is then located in the space 92 (FIG. 2) between the dies with one end of the bar disposed within one end of the sleeve. The piston 38 is then actuated by hydraulic or pneumatic pressure, via the ports in face plate 74, to effect the movement of the cylinder and associated die part 78 upward and towards the die 82 so as to compress the sleeve onto the bar. The operating pressure of the press is in the order of 600–1,000, generally 700, bars. This pressure is resisted by the engagement of the shoulder 88 with the surface 60, while the wedging action of the flanges 52 and 90 safeguards against the cap being moved out of engagement with the cylinder arms. The second bar is then located in the other end portion of the sleeve. The connection between the bars is then made in a similar manner by swaging along the length of the sleeve in successive bites (one or more bites, depending upon the length of the sleeve.).

The press may be relatively small in size, for example, in a press intended for splicing concrete reinforcing bars, bars of 25mm to 32mm in diameter, the cylinder can be from 340mm to 380mm high and 150mm to 180mm wide.

Generally, the bars are arranged in close proximity to one another, with the spacing between the individual bars being as little as 50mm and it is desired to splice an additional bar onto the end of one of the bars in the array. In such a case, the press is located horizontally such that the cylinder side arms bridge the ends of the bars to be connected. The splice sleeve is located over the ends of the bars and the arms are located on opposite sides of the bar splice sleeve assembly. The cap is then slid onto the arms of the cylinder. The piston is then actuated to press the splice onto the bars. The plate spring 64 serves to retract the piston after the completion of the splice. Then the cap 24 is disengaged from the arms 48 and the press 20 is withdrawn.

Without further elaboration, the foregoing will so fully illustrate my invention that others may, by applying current or future knowledge, readily adapt the same for use under various conditions of service.

What is claimed as the invention is:

1. A press adapted for use in confined spaces for forming a workpiece, said press comprising a cylinder having a longitudinal axis with a piston therein and reciprocable along said axis, said cylinder having an end from which a pair of arms extend in a direction generally parallel to said longitudinal axis, the outer surface of each of said arms being planar with the distance between the outer surfaces of said arms measured in a direction transverse to said longitudinal axis being less than the outer diameter of said cylinder, said arms also including tapered flanges, a bridging member in the form of a cap having tapered flanges thereon, said cap being detachably secured to said arms, with the flanges of said arms mating with the flanges of said cap, a first die part mounted for said reciprocable movement with said piston and a second die part mounted on said bridging member, said die parts cooperating together to form said workpiece by movement of said first die part toward said second die part in accordance with the movement of said piston along said axis.

2. The press of claim 1 wherein the cap includes a pair of side flanges extending from the underside of said cap, said side flanges including shoulders, each of said arms including an overhang against which an associated shoulder of said cap is arranged to abut to secure the cap onto said arms.

* * * * *